United States Patent [19]

Young

[11] Patent Number: 4,632,533

[45] Date of Patent: Dec. 30, 1986

[54] OFF-SET NIP ROLL DECURLER

[75] Inventor: Dale W. Young, North Chili, N.Y.

[73] Assignee: Xerox Corporation, Stamford, Conn.

[21] Appl. No.: 718,605

[22] Filed: Apr. 1, 1985

[51] Int. Cl.[4] ..... G03G 15/00

[52] U.S. Cl. ..... 355/3 SH; 355/3 FU; 355/3 R

[58] Field of Search ..... 355/3 SH, 14 SH, 3 FU; 271/161, 188, 209, 272, 273, 274, 314; 72/160, 162, 163, 166, 169; 493/395, 400, 401, 402, 403, 459, 460, 461; 162/223, 225, 270, 271; 101/1, 2, 91

[56] References Cited

U.S. PATENT DOCUMENTS

| | | | |
|---|---|---|---|
| 2,012,953 | 9/1935 | Brunner et al. | 162/271 |
| 2,070,505 | 2/1937 | Beck | 162/271 |
| 2,339,070 | 1/1944 | Hayes | 162/270 X |
| 4,060,236 | 11/1977 | Carstedt | 493/459 X |
| 4,077,519 | 3/1978 | Huber | 209/74 R |
| 4,190,245 | 2/1980 | Brandes | 162/271 X |
| 4,326,915 | 4/1982 | Mutschler | 162/271 |
| 4,360,356 | 11/1982 | Hall | 493/459 |
| 4,475,896 | 10/1984 | Bains | 493/454 |
| 4,505,695 | 3/1985 | Billings | 493/459 |
| 4,528,833 | 7/1985 | Inaike et al. | 493/459 X |
| 4,539,072 | 9/1985 | Frye et al. | 493/459 X |

*Primary Examiner*—A. C. Prescott

*Attorney, Agent, or Firm*—William A. Henry

[57] ABSTRACT

An apparatus in which sheet material is decurled. The apparatus includes off-set nips for reverse bending a sheet. As the sheet leaves a fuser, it is directed into one of two channels toward an off-set nip depending on the curl in the sheet. The off-set nip in conjunction with an output baffle reverse bends the sheet.

9 Claims, 3 Drawing Figures

OFF-SET NIP ROLL DECURLER

This invention relates generally to an electrophotographic printing machine, and more particularly concerns an apparatus for decurling sheet material employed therein.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member which corresponds to the informational areas contained within the original document being reproduced. This records an electrostatic latent image on the photoconductive member which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto.

As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes problems of handling as the sheet is processed in the printing machine. Sheets delivered in a curled condition have a tendency to have their edges out of registration with the aligning mechanisms employed in the printing machine. In addition curled sheets tend to frequently produce jams or misfeeds within the printing machine. In the past, this problem has been resolved by utilizing bars, rollers or cylinders which engage the sheet material as it passes through the printing machine. Frequently, belts or soft rollers are used in conjunction with a hard penetrating roll to remove the curl in a sheet. However, systems of this type have disadvantages. For example, the size of the decurler is not necessarily consistent with that required in some electrophotographic printing machines. In addition, decurlers of this type generally have a high running torque necessitating significant power inputs to operate successfully. Moreover, on many occasions, in electrophotographic printing, devices previously employed smeared the powder image. Also, a conventional decurler, which most often is of the belt/pinch roll type, has a single paper path. Although multiple bending can be set along the paper path, the single path is only effective in reducing paper curls that are primarily in one direction; it is not effective in reducing large curl in the other direction. In otherwords, if a conventional decurler is designed for flattening dominant TI (toward image) curls, it would not be able to reduce large AI (away image) curls significantly, and vice versa. For this reason, a single path decurler would fail to decurl thin papers as they exhibit both strong AI and TI curls (depending on which side is on the hot fuser roll) at high moisture content.

Various approaches have been devised to improve sheet decurlers to answer the above-detailed problems. The following diclosures appear relevant:

U.S. Pat. No. 4,077,519; Patentee: Huber; issued Mar. 7, 1978.

U.S. Pat. No. 4,325,915; Patentee: Mutschler, Jr.; issued Apr. 27, 1982

U.S. Pat. No. 4,360,356; Patentee: Hall; issued Nov. 23, 1982.

U.S. Pat. No. 4,475,896; Patentee: Bains; issued Oct. 9, 1984.

The pertinent portions of the foregoing disclosures may be summarized as follows:

Huber describes a curl detector and separator wherein a paper sheet is passed through the nip of a rotating roll and charging roll, and thereafter the sheet is stripped from the rotating roll by a vacuum stripper which allows the sheet to pass between the nip of a subsequent transport roll pair.

Mutschler, Jr. discloses a sheet decurler apparatus wherein a sheet is pressed into contact with a rigid arcuate member in at least two regions. The sheet moves about the arcuate member or rod in a curved path to remove curl in the sheet. The sheet is bent in one direction by a first rod and in another direction by a second rod.

Hall discloses an apparatus for removing curl from continuous web material during its travel through engagement bars that can be adjusted to remove AI or TI curl.

Bains describes a curling/decurling mechanism that combines a compliant roller with a soft outer layer in a curling roller to form a penetration nip with the compliant roller. Moveable plates are employed to control the angle of sheets as they exit from the nip.

In accordance with the features of the present invention, there is provided a dual-pass baffle decurler apparatus that decurls lightweight and thick papers and is equally effective in reducing TI and AI image curls. The apparatus includes off-set nips that receive sheets for reverse bending from a fuser. As the sheets leave a fuser they are directed into either of two paths depending on the direction and amount of curl induced into the sheets by the fuser. Sheets having TI curls are led into a first path defined by a first baffle and partition member surface, and sheets having AI curls are led into a second path defined by a second baffle and second partition member surface. Off-set nips receive the sheets within either path and decurl the sheets by driving them at predetermined angles toward output baffles.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
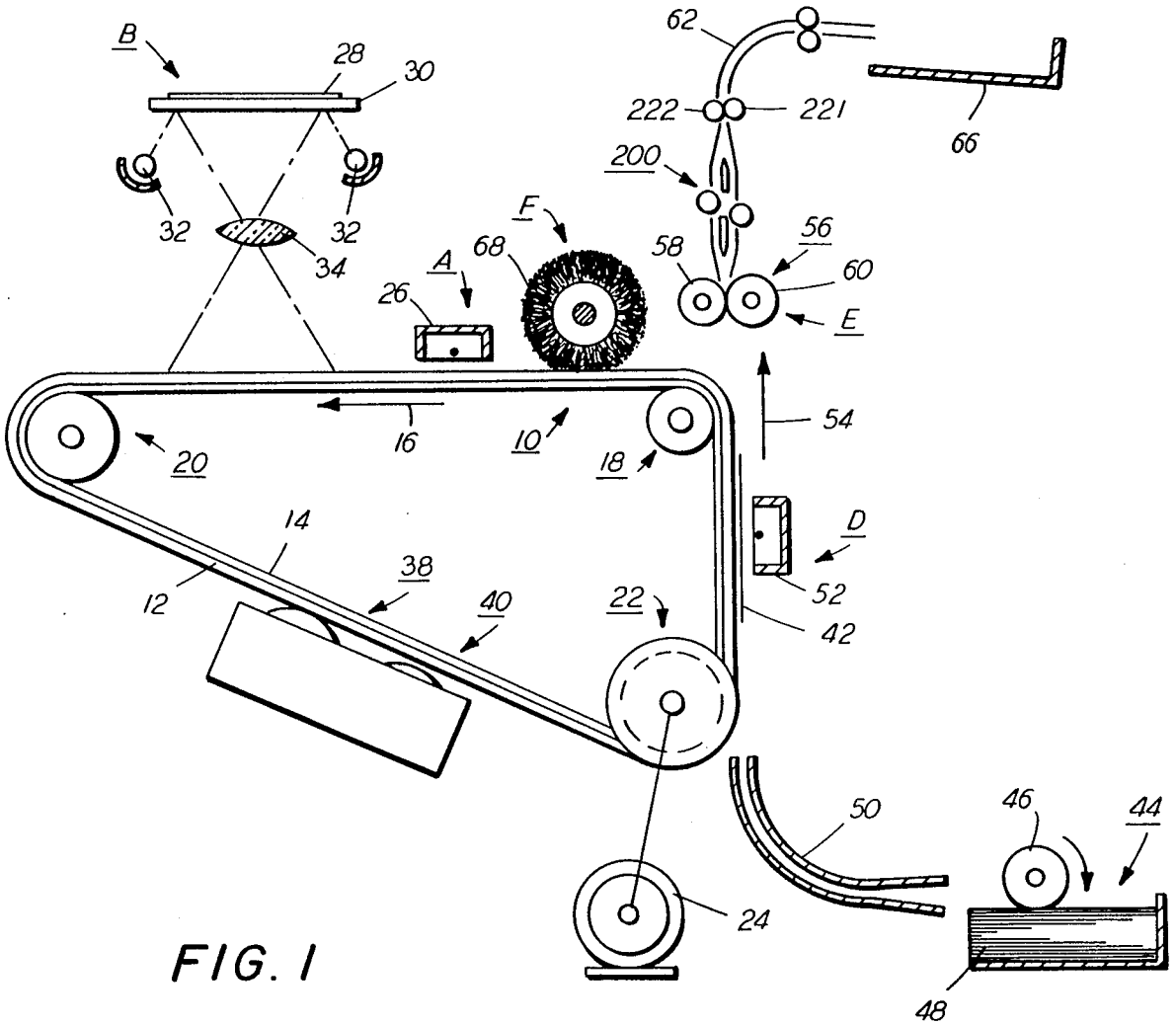
FIG. 1 is an elevational view illustrating schematically an electrophotographic printing machine incorporating the features of the present invention therein.

For a general understanding of the features of the present invention, reference is made to the drawings. In the drawings like reference numerals have been used throughout to designate identical elements. FIG. 1 schematically depicts the various components of an illustrative electrophotographic printing machine incorporating the decurling apparatus of the present invention therein. It will become evident from the following discussion that the decurling apparatus is equally well suited for use in a wide variety of printing machines and is not necessarily limited in its application to the particular embodiment shown herein. In addition, the location of the decurling apparatus, as depicted in the FIG. 1 electrophotographic printing machine, may be varied. The decurling apparatus may be positioned intermediate any of the processing stations within the printing machine. In the printing machine depicted in FIG. 1, the curling apparatus is positioned after the fusing station prior to the catch tray so as to straighten the final copy sheet prior to removal from the printing machine by the operator. However, this location is merely illustrative of the operation of the decurling apparatus and may be varied.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device, indicated generally by the reference numeral 26, charges photoconductive surface 12 to a relatively high, substantially uniform potential.

Thereafter, the charged portion of the photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advaces the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rollers each advance the developer material into contact with the photoconductive surface 12. Each developer roller forms a chain-like array of developer material extending outwardly therefrom. The toner particles are attracted from the carrier granules to the electrostatic latent image forming a toner powder image on photoconductive surface 12 of belt 10.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, a sheet feeding apparatus 44 includes a feed roll 46 contacting the uppermost sheet of stack 48. Feed roll 46 rotates to advance the uppermost sheet from stack 48 into chute 50. Chute 50 directs the advancing sheet of support material into contact with photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, a fuser assembly 56 includes a heated fuser roller 58 and a back-up roller 60. Sheet 42 passes between fuser roller 58 and back-up roller 60 with the toner powder image contacting fuser roller 58. In this manner, the toner powder image is heated so as to be permanently affixed to sheet 42. After fusing, sheet 62 guides advancing sheet 42 to the decurling apparatus, indicated generally by the reference numeral 200. At this time, the sheet of support material has undergone numerous processes and very frequently contains undesired curls therein. This may be due to the various processes through which it has been subjected, or to the inherent nature of the sheet material itself. Decurling apparatus 64 bends the sheet of support material so that the sheet material is strained to exhibit plastic characteristics. After passing through decurling apparatus 200, the sheet of support material is advanced into catch tray 66 for subsequent removal from the printing machine by the operator. The detailed structure of decurling apparatus 200 will be described hereinafter with reference to FIGS. 2 and 3.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fiberous brush 68 in contact with photoconductive surface 12. The pre-clean corona generating device neutralizes the charge attracting the particles to the photoconductive surface. The particles are then cleaned from photoconductive surface 12 by the rotation of brush 68 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrophotographic printing machine incorporating the features of the present invention therein.

Figure 2:
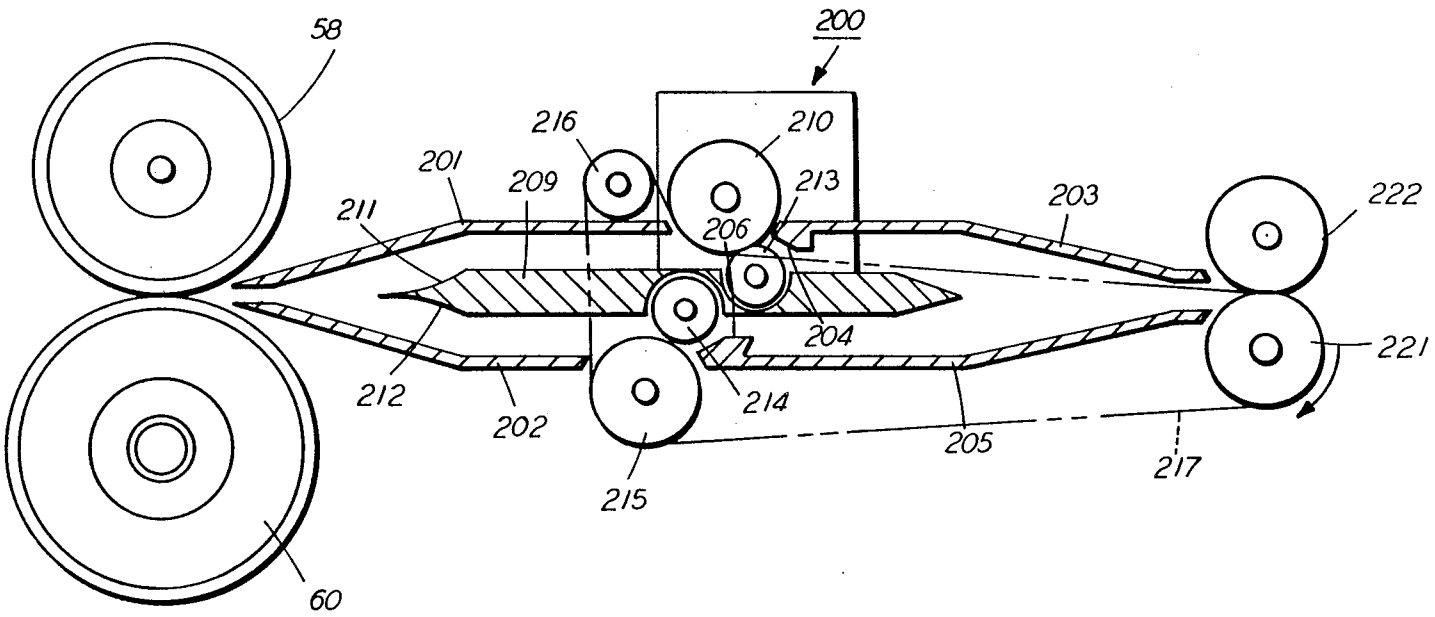
FIG. 2 is a 90° clockwise rotated elevational view showing the decurling apparatus of the present invention used in the printing machine of FIG. 1.
Figure 3:
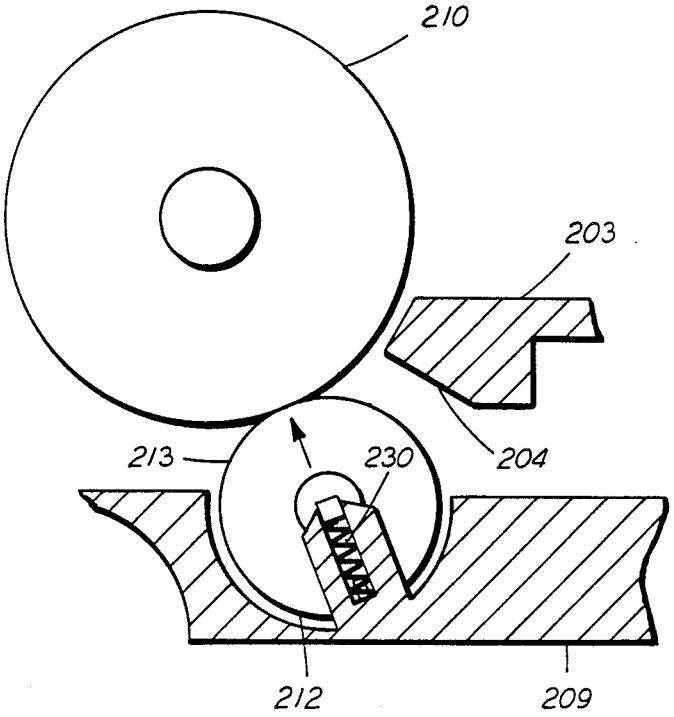
FIG. 3 is an enlarged partial view of the apparatus in FIG. 2 showing an idler roll spring loaded against a drive roll.

Referring now to the subject matter of the present invention, FIG. 2 depicts an embodiment 200 of the decurler apparatus of the present invention in detail. The decurling apparatus 200 features two paths for reverse bending AI (away from image) and TI (toward image) curls (paper path self-determined by direction of fuser curl). Decurler 200 requires no adjustment and is capable of reliably handling 13# through 110# papers with a wide latitude of moisture content. The decurler is cost effective because no belts or stepped rolls for belts are used as in conventional decurlers. As heretofore mentioned, a conventional decurler has a single path and uses multiple bends along the path to accomplish decurling. However, the single path is effective in removing curl in only one direction. In order to overcome this limitation, the decurler apparatus 200 incorporates two paper paths. These paper paths take advantage of the fact that fused papers already show clear TI or AI curl tendency in a short distance (about 0.5 inches) from the fuser nip. Capitalizing on the well developed curl directions, partition baffle 209 has surfaces 211 and 212 that are positioned to guide the lead edges of papers into two paths. As shown in FIG. 2, papers or sheets of any kind having TI are led into a first path defined by guide surface 211 of partition member 209 and baffle 201. Baffle 201 also serves as a stripper means to prevent sheets from wrapping around roll 58. In this first path, sheets continue toward an off-set nip formed between rolls 210 and 213. Drive roll 210 and idler roll 213 drive the curled sheets at a predetermined angle (reverse bending) against a slanted or beveled surface 204 of output baffle 203 and subsequently into the output nip formed by rolls 221 and 222 for transport into output tray 66. The baffle 203 with surface 204 reverse bends the sheets for straightening. As shown in FIG. 3, the nip comprises a drive roll 210 and idler roll 213 that is spring loaded by spring 230 against drive roll 210. The drive roll drives the sheets at a predetermined angle toward output baffle 203 through a drive force provided by belt 217. Belt 217 is connected to provide drive force to rolls 210, 215, 216, and 221.

Similarly, sheets having AI curls are guided for reverse bending (TI) in a second path defined by guide 202 and beveled surface 212 of partition member 209 into an off-set nip formed between drive roll 215 and idler roll 214. The sheets are driven out of the off-set nip against slanted surface 206 of output baffle 205 for reverse bending and straightening and are straightened into output nip 221, 222 for transport toward catch tray 66.

In recapitulation, it is apparent that a decurler apparatus has been disclosed in which a sheet chooses one of two paths for decurling depending upon the amount and direction of the curl. The decurler includes off-set nips from a vertical plane that in combination with output baffles apply reverse bending to the sheets in order to straighten them. The nips comprise drive rolls and idler rolls that are biased against the drive rolls. The drive rolls drive the sheets at a predetermined angle toward the output baffles.

It is, therefore, evident that there has been provided, in accordance with the present invention and apparatus for decurling a sheet of support material being used in an electrophotographic printing machine. This apparatus fully satisfies the aims and advantages hereinbefore set forth. While this invention has been described in conjunction with a specific embodiment thereof, it is evident that any alternatives, modifications, and variations will be apparent to those skilled in the art. Accordingly, it is intended to embrace all such alternatives, modifications, and variations as fall within the spirit and scope of the appended claims.

What is claimed is:

1. An apparatus for decurling sheet material, including:

first and second guide baffle means for receiving sheets to be decurled;

partition means positioned within said first and second baffles, said partition means having dual beveled surfaces adapted to direct sheets received by said first and second guide baffle means into one of two paths depending on the direction and amount of curl in the sheets;

off-set nip means for receiving sheets being transported in either of said two paths and driving the sheets at a predetermined angle; and output baffle means positioned adjacent said off-set nip, said output baffle means having a beveled edge adapted to work in combination with said off-set nip means to apply reverse bending to sheets as they are driven into said beveled edge of said output baffle means by said off-set nip means.

2. The apparatus of claim 1, wherein said off-set nip means comprises a drive roll and an idler roll with said idler roll being spring biased against said drive roll.

3. The apparatus of claim 2, wherein said first and second guide baffle means includes sheet stripping means.

4. A printing machine adapted to produce copies on sheets fed through a plurality of processing stations in the machine including a fuser, the machine having a sheet decurling device for removing curl in the sheets after they have left the fuser, said sheet decurling device comprising:

first and second guide baffle means for receiving sheets to be decurled;

partition means positioned within said first and second baffles, said partition means having dual beveled surfaces adapted to direct sheets received by said first and second guide baffle means into one of two paths depending on the direction and amount of curl in the sheets;

off-set nip means for receiving sheets being transported in either of said two paths and driving the sheets at a predetermined angle; and output baffle means positioned adjacent said off-set nip, said output baffle means having a beveled edge adapted to work in combination with said off-set nip means to apply reverse bending to sheets as they are driven into said beveled edge of said output baffle means by said off-set nip means.

5. The machine of claim 4, wherein said off-set nip means comprises a drive roll and an idler roll with said idler roll being spring biased against said drive roll.

6. The machine of claim 5, wherein said first and second guide baffle means includes sheet stripping means.

7. The machine of claim 4, wherein one of two paths through said decurler is automatically selected as the sheet material leaves the fuser.

8. A printing machine adapted to produce copies on sheets fed through a plurality of processing stations in the machine, the machine having a sheet decurling device for removing curl in sheets before they exit the machine, said decurler device comprising:

means for receiving sheets in transit within the machine; and means for automatically selecting one of two paths through said decurler device for each sheet in transit within the machine and wherein the automatic selection of one of said two paths depends upon whether the sheets have toward image curl or away from image curl.

9. The printing machine of claim 8, wherein sheets traveling in said two paths are initially decurled in one of two directions.

* * * * *